United States Patent [19]

LaRock

[11] Patent Number: 4,818,820

[45] Date of Patent: Apr. 4, 1989

[54] TRANSMISSION SYSTEM

[75] Inventor: Gary J. LaRock, Middlebury, Vt.

[73] Assignee: Joslyn Corporation, Chicago, Ill.

[21] Appl. No.: 37,543

[22] Filed: Apr. 13, 1987

[51] Int. Cl.[4] ..... H01B 7/08; H01B 7/34

[52] U.S. Cl. ..... 174/36; 139/425 R; 174/117 M

[58] Field of Search ..... 174/36, 117 M, 117 F, 174/117 FF, 117 R, 32, 103; 139/425 R

[56] References Cited

U.S. PATENT DOCUMENTS

| | | | |
|---|---|---|---|
| 272,441 | 2/1883 | Hunter | 174/117 M |
| 3,582,532 | 6/1971 | Plummer | 174/36 |
| 3,582,537 | 6/1971 | Perreault | 174/117 M |
| 3,646,247 | 2/1972 | Sennett et al. | 174/117 M |
| 4,158,104 | 6/1979 | Ross | 174/117 M |
| 4,409,427 | 10/1983 | Plummer, III | 174/36 |
| 4,442,314 | 4/1984 | Piper | 174/117 M X |
| 4,468,089 | 8/1984 | Brorein | 174/36 X |
| 4,481,379 | 11/1984 | Bolick, Jr. et al. | 174/36 |
| 4,513,170 | 4/1985 | Apodaca | 174/36 |
| 4,616,102 | 10/1986 | Noorily | 174/36 |

*Primary Examiner*—Morris H. Nimmo

*Attorney, Agent, or Firm*—Mason, Kolehmainen, Rathburn & Wyss

[57] ABSTRACT

A multi-conductor transmission system employs a plurality of individual conductors retained in a woven web assembly to form an organized signal transmission line. The conductors in the system may all be the same or different conductors may be used, and the conductors may be enclosed by a shield. Another shield or ground plane may be used to provide isolation between predetermined conductors of the line. The conductors may be arranged in a manner to maximize isolation between potentially interfering signals, and to permit standardized wiring arrangements. Impedance control is provided by accurately locating the conductor with respect to each other and with respect to any ground plane and shield.

4 Claims, 2 Drawing Sheets

TRANSMISSION SYSTEM

BACKGROUND OF THE INVENTION

1. Field of the Invention

This invention relates generally to transmission systems, and more particularly to a multiconductor transmission line that employs a plurality of individual conductors with each conductor capable of transmitting a different signal. The conductors are supported in a spaced relationship in a woven web to provide physical separation between the conductors and to provide a predefined physical placement of each conductor with respect to the other conductors in the web. This permits the conductors to be arranged in a manner to segregate conductors carrying potentially interfering signals, and to permit opposite ends of the various conductors to be readily identified. The precise placement of the individual conductors also provides accurate impedance control. Additional shielding may be provided by means of an exterior braid or shield or by means of an interior shield or ground plane between predetermined conductors.

2. Description of the Prior Art

While prior art transmission systems are known, such systems generally take the form of one or more shielded coaxial cables, used for signalling purposes, used in conjunction with ribbon cable or single or multi-conductor cable used primarily for power transmission or low frequency signalling. While such systems do provide a way to transmit power and high and low frequency signals, ribbon cables are limited in current carrying capacity and are prone to electromagnetic interference. Consequently, specialized cables, such as coaxial cables or power cables are required when interference immunity or current carrying capacity is required. In addition, opposite ends of conductors within multi-conductor cables must be identified, typically by means of identifying tags and/or color coding to permit the cables to be appropriately connected. Also, because of the random placement of conductors within a multi-conductor cable, impedance control is not possible and the possibility of interference between signals exists. If such interference is to be eliminated, special shielding between susceptible conductors must be provided, for example, in the form of coaxial cables either inside or outside of the multi-conductor cable.

SUMMARY OF THE INVENTION

Accordingly, it is an object of the present invention to provide a transmission system that overcomes many of the disadvantages of the prior art systems.

It is another object of the present invention to provide a transmission system that provides isolation between various signals without excessively increasing the bulk of the transmission system.

It is another object of the present invention to provide an organized multi-conductor transmission system that simplifies wiring between components.

It is another object of the present invention to provide a multi-conductor organized transmission system that is compact, provides substantial isolation between potentially interfering signals and ready interconnection without the use of individually coded conductors.

It is another object of the invention to provide a multi-conductor transmission line that provides accurate control of the characteristic impedance of the various conductors.

Thus, in accordance with a preferred embodiment of the invention, there is provided a multiconductor woven transmission cable system that utilizes a plurality of conductors supported in a woven web structure. The conductors are woven to provide a predetermined physical placement so that opposite ends of the conductors may be readily identified and connected to, for example, standardized connectors to provide standardized transmission paths that may readily be plugged into various components. The signals on the individual conductors may be organized so that potentially interfering signals are separated to minimize interference. If further isolation is required, a shield or ground plane may be interposed between susceptible conductors, and another shield or braid may be used to provide additional electromagnetic interference protection. The precise physical placement of the conductors within the web permits the characteristic impedance of the various conductors in the cable to be accurately controlled.

DESCRIPTION OF THE DRAWING

These and other objects and advantages of the present invention will become readily apparent upon consideration of the following description and attached drawing, wherein:

FIG. 8 illustrates an unshielded version of the cable of FIG. 7.

DETAILED OF THE PREFERRED EMBODIMENT

Figure 1:
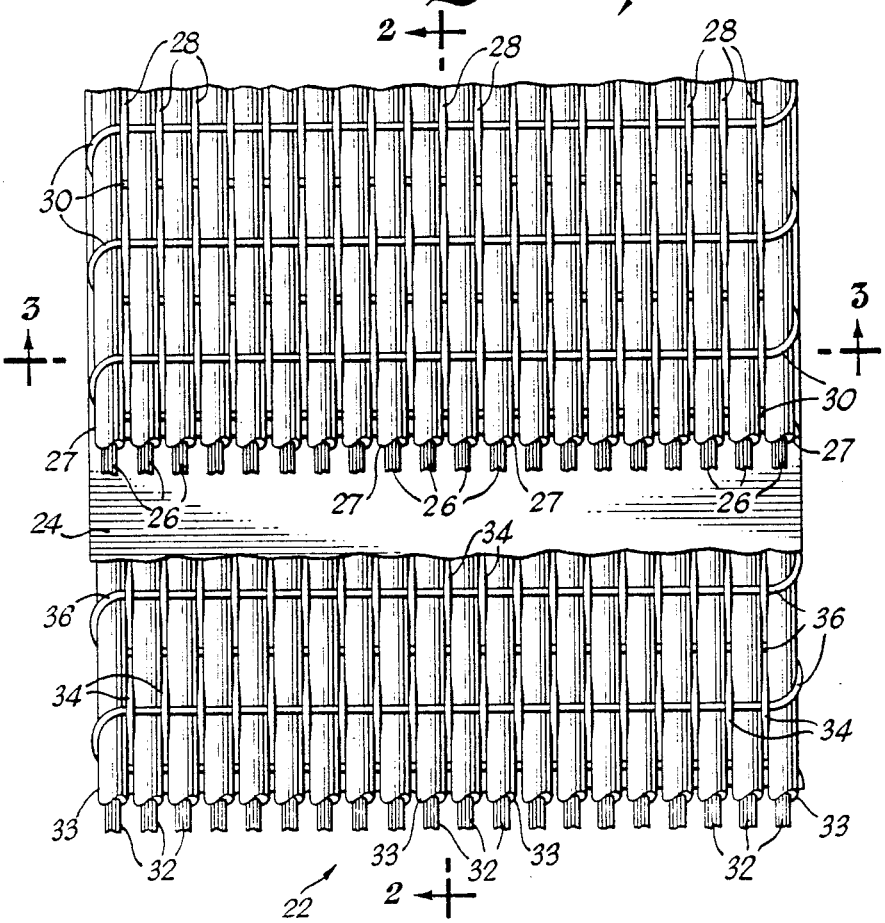
FIG. 1 is a partially cut-away plan view of the cable according to the invention.
Figure 2:
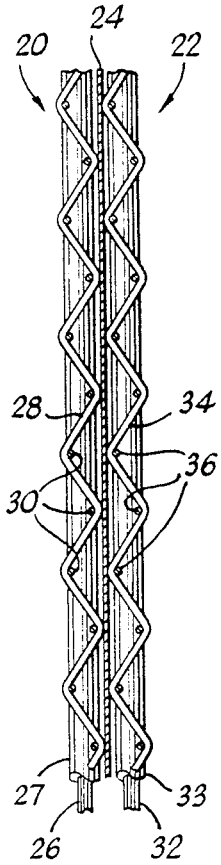
FIG. 2 is a sectional view of the cable according to the invention taken along line 2—2 of FIG. 1.
Figure 3:
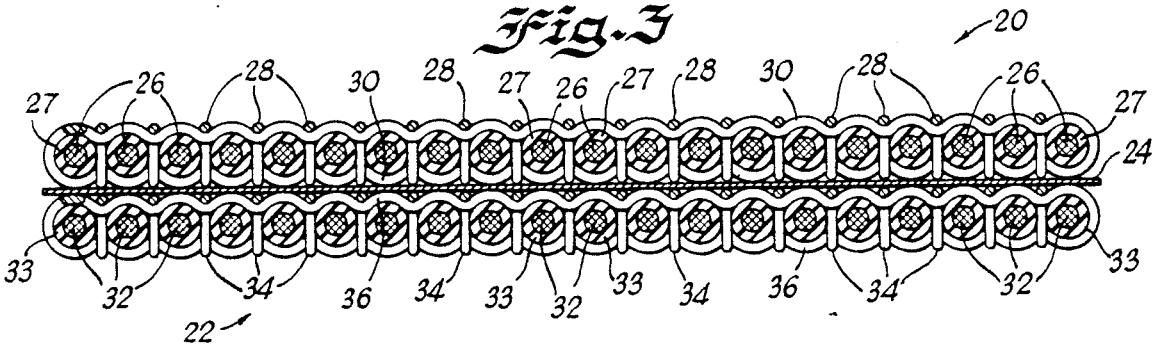
FIG. 3 is a sectional view of the cable according to the taken along line 3—3 of FIG. 1.

Referring now to the drawing, with particular attention to FIG. 1, there is shown a plan view of the transmission system according to the invention. The transmission system includes a woven cable assembly containing, in the illustrated embodiment, two layers of signal carrying conductors, namely, a first layer 20 and second layer 22. The layers 20 and 22 are separated by a shield, which in the illustrated embodiment, takes the form of a conductive sheet such as a copper sheet 24 which may be grounded or attached to a source of fixed potential for providing electrical isolation between the layers 20 and 22. The layer 20 comprises a plurality of individual conductors 26 that are insulated by a layer of insulation 27 and secured in a woven web structure by a supporting web woven from, for example, fabric cord. The woven web includes a plurality of longitudinal strands or cords 28 intertwined with a transverse strand or cord 30. In the illustrated embodiment, the cord 30 encircles the web and the conductors 26 and is interwoven with the longitudinal cords 28. The cords 28 and 30 may be made of any stranded or unstranded weaveable material including various fabrics, plastic and other materials that are relatively flexible and suitable for weaving.

A second plurality of conductors 32 that are surrounded by a layer of insulation 33 is disposed on the opposite side of the shield 24 and supported in the woven structure 22 by a plurality of longitudinal cords 34 interwoven with an encircling transverse cord 36. The woven assembly 24 is thus similar to the woven assembly 22. If desired, additional woven structures may be utilized. Additional shields between the additional structures may be employed if necessary. Alternatively, only a single shielded or unshielded woven assembly may be used.

In designing cable transmission systems, particularly, when high frequency signals are being transmitted, the characteristic impedance of the transmission line becomes important, and a predictable and uniform characteristic impedance is necessary to avoid unwanted reflections and excessive insertion loss. These objects are achieved by the system according to the present invention because the various conductors 26 and 32 are securely held in the web structure 20 and 22 in a fixed relationship with respect to the shield 24, thus assuring a relatively constant characteristic impedance for each of the conductors 26 and 32. This characteristic impedance may be controlled by controlling the spacing between adjacent conductors and between the various conductors and the shield. The spacing between conductors controls the characteristic impedance between two adjacent conductors forming a balanced transmission line, while the spacing between a conductor and a shield controls the characteristic impedance of an unbalanced transmission line formed from a conductor and the shield.

In many applications, it is necessary to transmit various different signals ranging from DC power to radio frequency signals, including signals, such as communications, video and digital signals, down the same transmission system. Many of these signals have the potential to interfere with each other. Such signals have in the past been isolated by transmitting through individual isolated cables. However, when individual cables are used, it is necessary to mark or otherwise keep track of opposite ends of each cable to assure that the wiring is done correctly. Thus, in accordance with an important aspect of the present invention, because the various individual conductors of the present structure are accurately retained in position, it is possible to isolate potentially interfering signals by applying such signals to conductors that are sufficiently spaced apart to prevent interference. In some instances, it may be necessary to apply potentially interfering signals to conductors located on opposite sides of the shield 24 to provide sufficient isolation; however, this can be readily accomplished with the present system. Thus, in accordance with the present invention, an ordered signal transmission system can be provided, with signals that do not interfere with each other being transmitted by adjacent or closely spaced conductors, and those that have a possibility of interfering being transmitted by conductors that are spaced apart from each other, with the amount of spacing being increased with the probability of interference. Thus, for example, low frequency DC power or audio signals may be applied to adjacent conductors while higher frequency video, radio frequency or digital signals may be isolated from each other through spacing or shielding. For example, signals having a high interference potential may be carried by conductors on opposite sides of the shield 24: Where the probability of interference is less they may be carried by spaced apart ones of the conductors 26 or 32 on the same side of the shield 24. In addition, because the individual conductors 26 and 32 are retained in a fixed relationship with respect to each other by the woven structure, it is not necessary to identify opposite ends of the various conductors because the opposite ends of the various conductors can be readily ascertained by viewing their relative position at the opposite ends of the woven web structures 20 and 22.

Figure 4:
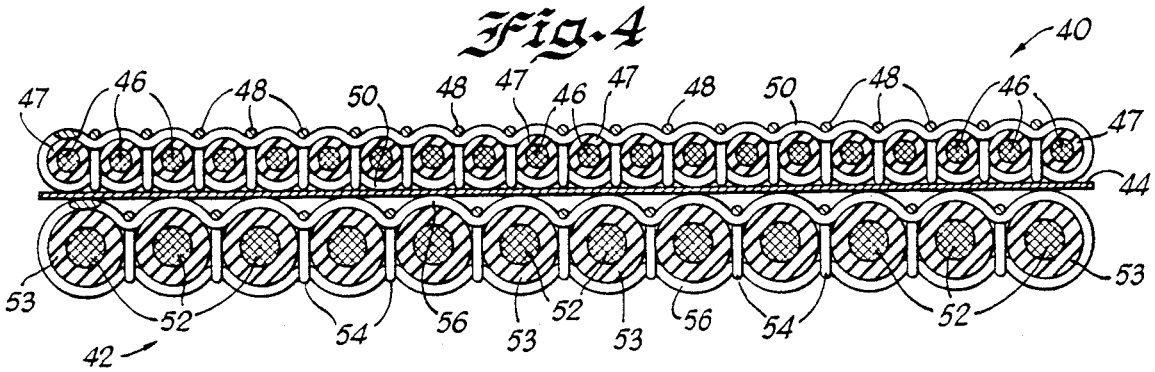
FIG. 4 is a sectional view similar to FIG. 3 showing another embodiment of the invention.
Figure 5:
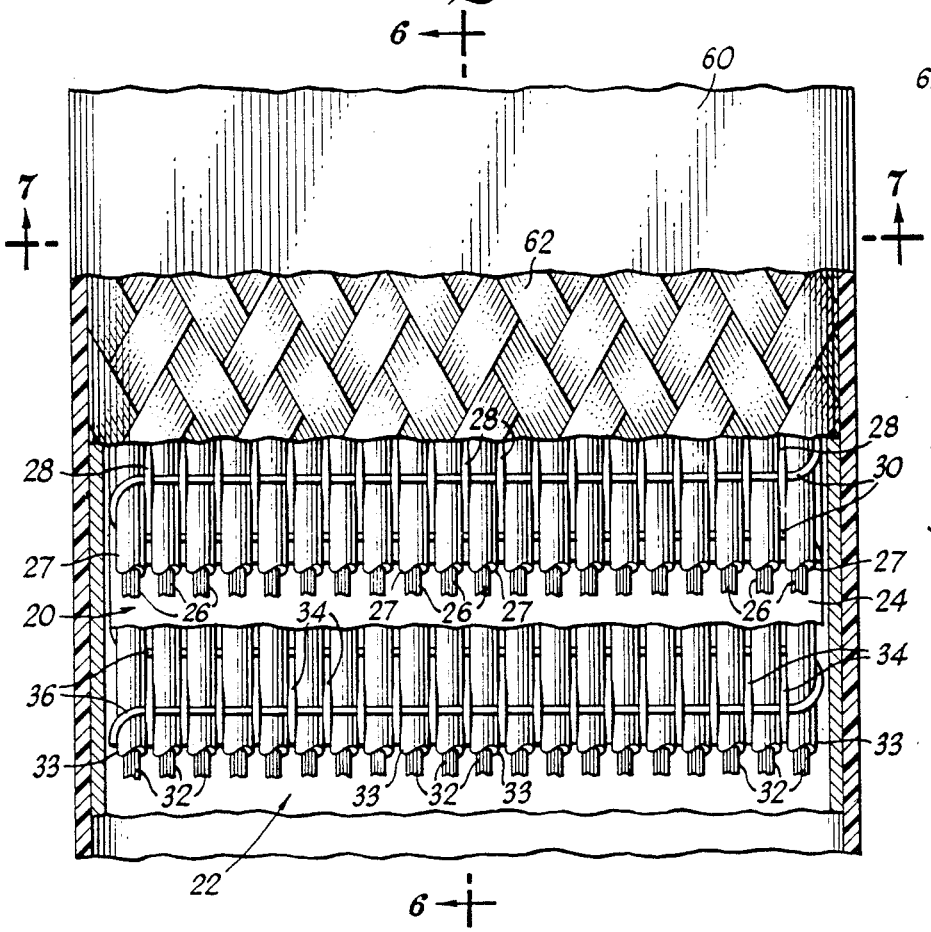
FIGS. 5–7 are similar to FIGS. 1–3, respectively, showing a ion of the cable of FIGS. 1–3.
Figure 6:
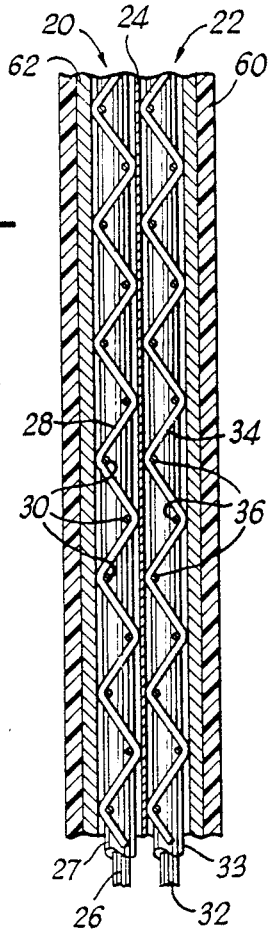
Figure 7:
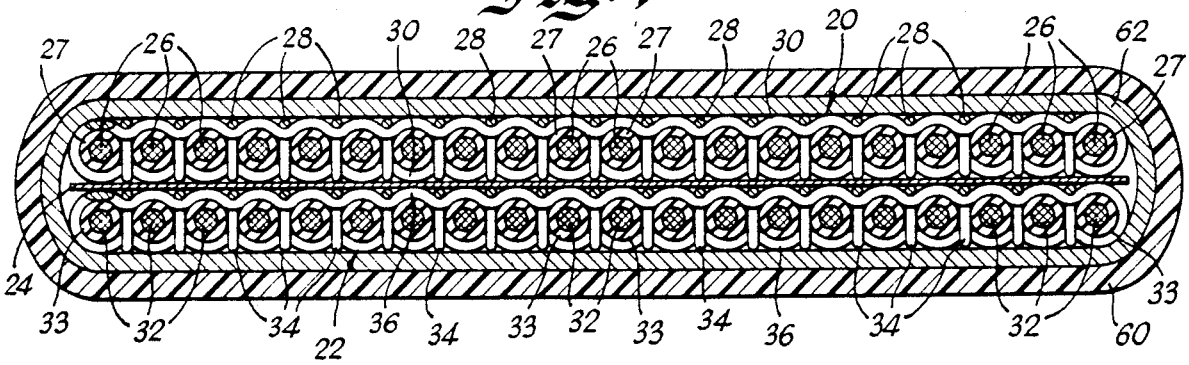
Figure 9:
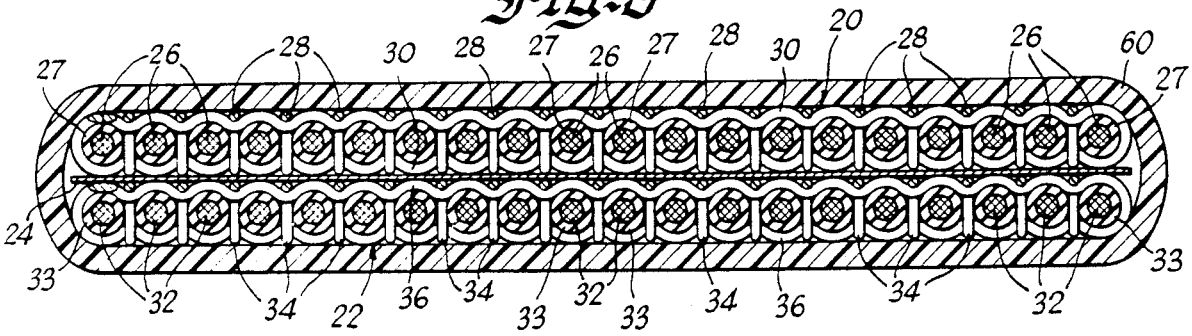

As previously stated, the web structure carrying the various conductors may include conductors carrying high power as well as low power signalling information. Consequently, the sizes of the various conductors need not be the same because signalling conductors generally do not carry the same amount of current as do power carrying conductors. Consequently, in instances where both relatively high power as well as signalling currents are being transmitted through the same transmission system, it may be desirable to utilize conductors of various diameters, as illustrated in FIG. 4. In the system illustrated in FIG. 4, there is provided an upper web structure 40 that is separated from a lower web structure 42 by a shield 44. A plurality of conductors 46 are retained in the web structure by interwoven, laterally extending and longitudinally extending strands or cords 48 and 50, respectively. Similarly, larger diameter conductors 52 are maintained in position by an interwoven web consisting of longitudinally and laterally extending strands or cords 54 and 56, respectively. Thus, signal and power carrying conductors are separated by the shield 44, with the larger conductors that are better adapted to carry power being isolated from the smaller signal carrying conductors by the shield 44. The conductors 46 and 52 are insulated by suitable layers of insulation 47 and 53, respectively.

In addition, in many instances, it is necessary to prevent interference between the signals carried by the conductors and the external environment. Thus, in many instances, it may be necessary to provide an external shield, such as, for example, a woven shield 62 around the woven assemblies. Such a shield may be fabricated from woven metal strands, as is illustrated, or may take the form of a metal foil shield or a metallized plastic foil shield. The shield 62 thus encircles the various conductors 26 and 32 of the woven web assemblies and 20 and 22 to prevent interference between the conductors 26 and 32 and the outside environment. Because of the accurate positioning of each of the conductors 26 and 32 in the web structures 20 and 22, the shield 62 affects the characteristic impedance of the various conductors in a predictable and uniform fashion, thus providing a predictable impedance match between the transmission system and the systems to which it is connected.

In many instances, it is necessary to protect the transmission system from environmental conditions, such as dirt, humidity or a corrosive or otherwise harmful atmosphere. This may be readily achieved by surrounding the metal shield 62 by a jacket, for example, a plastic jacket 60. The jacket 62 may be fabricated from any suitable material that is impervious to the environment surrounding the woven structure to protect the woven structure from any hostile environment. In the event that an anti-interference, electromagnetic shielding is not required, but protection against a hostile environment is required, the protective shield 60 may be positioned directly about the woven assemblies without having an electromagnetic shield disposed between the environmental shield 62 and the woven assemblies.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A cable transmission system comprising:
a first plurality of individual conductors;
a second plurality of individual conductors;
an insulating layer surrounding each of said individual conductors;
means for determining the characteristic impedance of said conductors, said characteristic impedance determining means including in combination an electrically conductive shield member, a first woven web structure and a second woven web structure, the individual conductors of said first plurality of individual conductors being supported by said first web structure in a fixed, predetermined spaced relationship with respect to each other and the individual conductors of said second plurality of individual conductors being supported by said second web structure in a fixed, predetermined spaced relationship with respect to each other, said shield member being disposed between said first and second web structures, said shield member having a width substantially equal to a width of said first and second plurality of individual conductors to thereby determine the characteristic impedance between said first and second plurality of individual conductors and between said first and second plurality of individual conductors and said shield member.

2. A cable transmission system as recited in claim 1 wherein the individual conductors of said first plurality of individual conductors and said second plurality of individual conductors have different diameters.

3. A cable transmission system as recited in claim 1 further including a second shield member surrounding said first web structure and said second web structure.

4. A cable transmission system as recited in claim 1 wherein each said web structure includes a plurality of elongated web members disposed adjacent to said conductors in a parallel relationship therewith, and a second elongated web member disposed transverse to said elongated web members and to said conductors.

* * * * *